United States Patent [19]

Artama et al.

[11] Patent Number: 4,553,987

[45] Date of Patent: Nov. 19, 1985

[54] CONTINUOUSLY RINSED ELECTRIC DUST COLLECTOR

[75] Inventors: Arvi Artama, Tampere; Uuno Nurmi, Helsinki, both of Finland

[73] Assignee: Lastro Ky, Ylojarvi, Finland

[21] Appl. No.: 571,658

[22] Filed: Jan. 12, 1984

Related U.S. Application Data

[63] Continuation-in-part of Ser. No. 359,720, Mar. 11, 1982, abandoned.

[51] Int. Cl.[4] ..... B03C 3/16; B03C 3/53

[52] U.S. Cl. ..... 55/118; 55/138; 55/155

[58] Field of Search ..... 55/118, 119, 138, 155

[56] References Cited

U.S. PATENT DOCUMENTS

| | | | |
|---|---|---|---|
| 2,414,528 | 1/1947 | Hutchison et al. | 55/118 X |
| 2,448,046 | 8/1948 | Penney et al. | 55/118 |
| 2,555,216 | 5/1951 | Wintermute | 55/118 |
| 2,579,552 | 12/1951 | Cummings | 55/118 |
| 2,958,393 | 11/1960 | Lueder | 55/155 |
| 2,978,066 | 4/1961 | Nodolf | 55/155 X |
| 3,238,702 | 3/1966 | De Seversky | 55/119 |
| 3,248,857 | 5/1966 | Weindel et al. | 55/118 |
| 3,372,529 | 3/1968 | Harms | 55/118 |
| 3,650,092 | 3/1972 | Gourdine et al. | 55/155 X |
| 3,716,966 | 2/1973 | De Seversky | 55/118 |
| 3,740,926 | 6/1973 | Duval | 55/138 X |
| 3,742,680 | 7/1973 | Severs | 55/155 X |
| 3,744,217 | 7/1973 | Ebert | 55/118 |
| 4,189,308 | 2/1980 | Feldman | 55/119 X |
| 4,265,641 | 5/1981 | Natarajan | 55/118 X |

FOREIGN PATENT DOCUMENTS

| | | | |
|---|---|---|---|
| 845495 | 7/1952 | Fed. Rep. of Germany . | |
| 2823971 | 12/1978 | Fed. Rep. of Germany | 55/118 |
| 783720 | 1/1981 | Finland . | |
| 2380818 | 9/1978 | France . | |
| 53-69980 | 6/1978 | Japan | 55/155 |
| 1530203 | 10/1978 | United Kingdom . | |
| 1542202 | 3/1979 | United Kingdom . | |
| 2005158 | 4/1979 | United Kingdom . | |

*Primary Examiner*—Kathleen J. Prunner
*Attorney, Agent, or Firm*—Pollock, Vande Sande & Priddy

[57] ABSTRACT

An electric dust collector has a chamber through which a gas to be cleaned is directed by a fan. A precipitating device in the chamber includes ionization electrodes and counter-electrodes upstream of an electrostatic field formed by positive and negative electrodes. The negative electrodes serve as collector electrodes for accumulating impurity particles from the air being cleaned and comprise a water film continuously flowing over a plate made of electrically insulating glass having wettable properties. Pipes extending in the direction of the upper edge of the collector electrodes have apertures for directing currents of water onto the plates and are connected to ground so that the water film has a polarity opposite to that of the particles.

3 Claims, 6 Drawing Figures

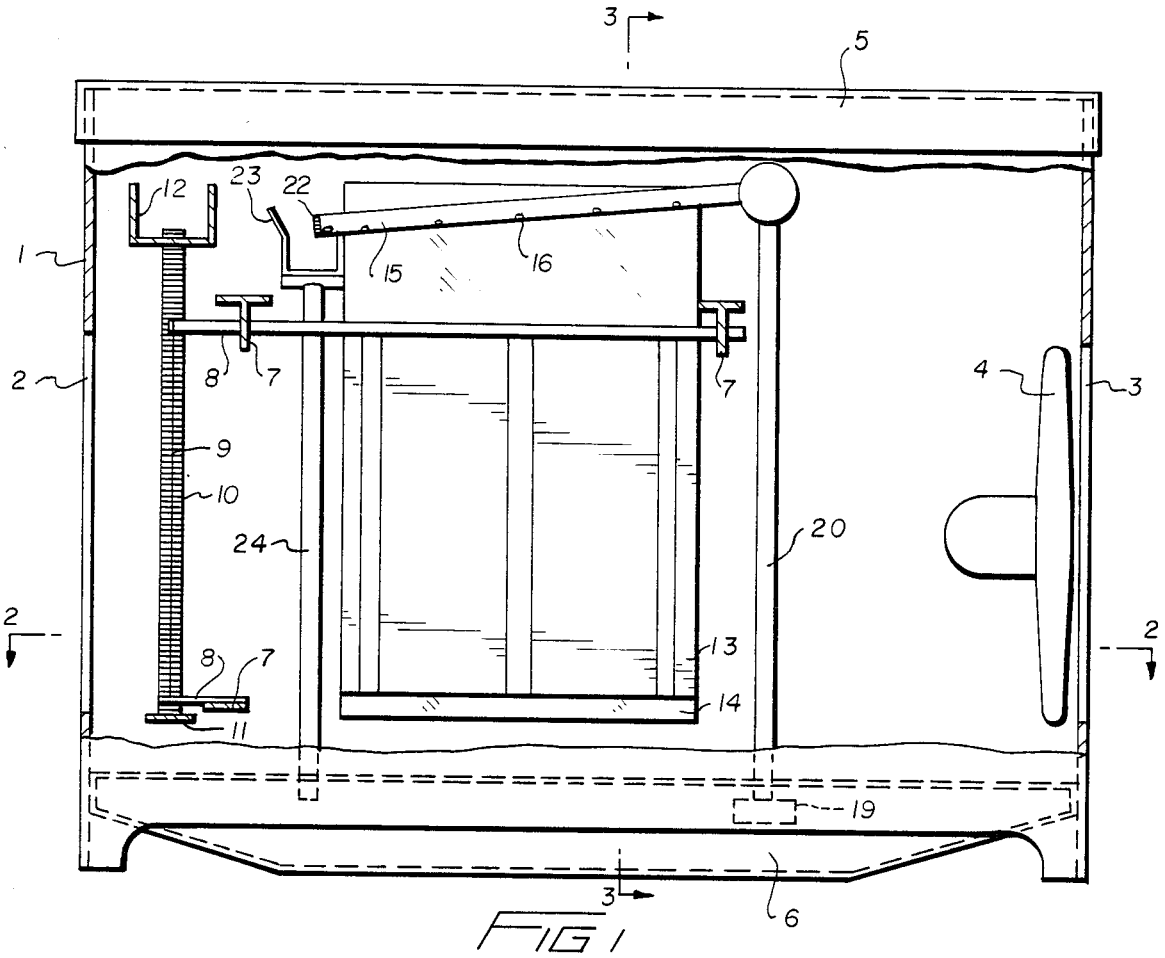
FIG 1
FIG 2
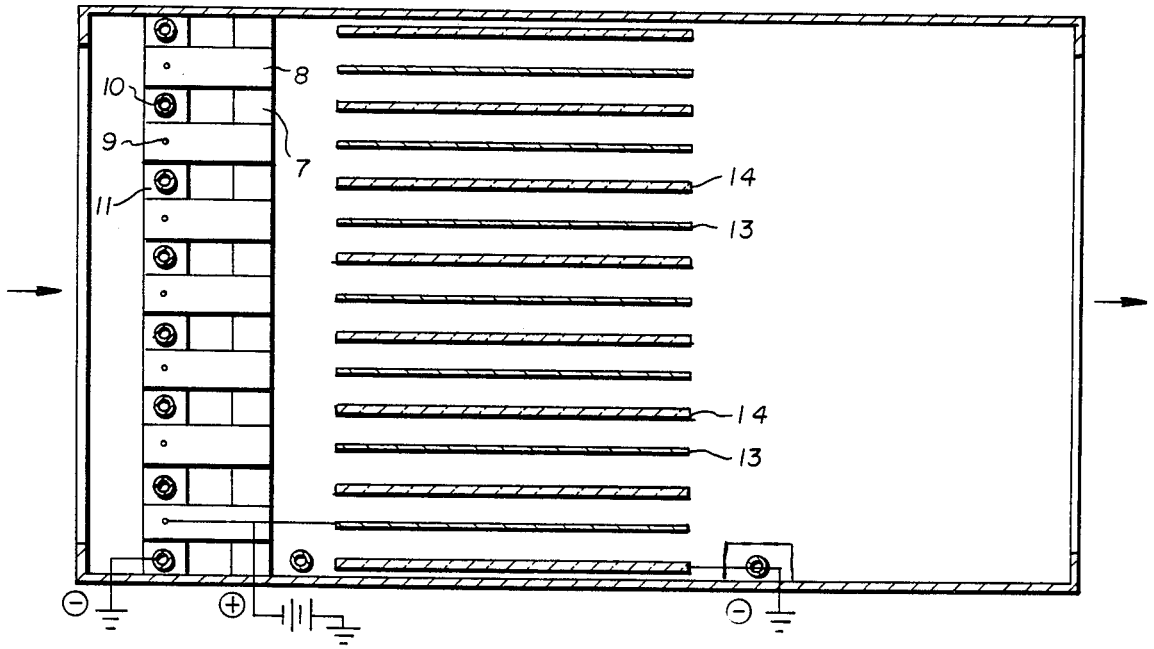

CONTINUOUSLY RINSED ELECTRIC DUST COLLECTOR

RELATED APPLICATIONS

This is a continuation-in-part of Ser. No. 359,720 filed Mar. 11, 1982, abandoned, the entire contents of said prior application being expressly incorporated herein by reference.

TECHNICAL FIELD

The invention relates to so-called electric dust collectors, the purpose of which is to separate from air or other gases small liquid or solid particles by means of an electrostatic method.

BACKGROUND OF THE INVENTION

In known electric dust collectors, particles attached to the collection plate are caused to drop to the bottom of the precipitator either by shaking the collection plate at specified time intervals or by rinsing it down with water. They are then removed from the base of the precipitator. Various drawbacks are however associated with this mode of operation. Thus some particles may adhere so firmly to the dry electrode that shaking at intervals or rinsing does not suffice to clean the electrode. Continuous rinsing of the collection electrode may not be practicable due to complete coverage of the electrode not being attainable with moderate water consumption. A layer of particles then gathers on the dry portions and causes a short circuit. This then requires interruption of the operation of the dust collector and special cleaning procedures. Other particles, for example quartz dust and carbon dust, may bounce off the dry electrode when they exchange their original electric charge for that of the collection electrode.

SUMMARY OF THE INVENTION

The purpose of the invention is to provide an electric dust collector from which the aforementioned drawbacks have been removed. In this, continuous rinsing of the precipitator collection plate is carried out completely with comparatively low water consumption resulting in all types of solid particles over the whole electrode area being carried away by the flowing water film and removed with it from the electric field.

The invention is characterized by the fact that the impure particle collection plates situated in the electrostatic field are made of glass or other electrically insulating material which is wetted by water. In this way, the rinsing water is caused to spread with great effectiveness over the surface of the plate and cover it completely yet in a thin layer. The water film thus acts as an electrode, since the glass does not conduct electricity. Because the rinsing takes place continuously, the dust particles do not come into contact with the plate, but are seized by the water film and immediately rinsed away from the electric field. The plates accordingly remain completely clean, and no separate cleansing measures are necessary. At the same time, the danger of fire is removed which may appear in those environments in which the dust produced is flammable, as for example in the wood processing industry, mills, etc.

The invention is described in more detail in the following description in which with reference to the drawings a suitable embodiment of the invention is presented together with details and advantages of the invention.

BRIEF DESCRIPTION OF THE DRAWINGS

In the accompany drawings,

FIG. 1 shows diagrammatically the electric dust collector according to the invention seen from the side, partly sectioned, FIG. 2 shows diagrammatically a horizontal cross-section of the electric dust collector along line 2—2 in FIG. 1, and also a circuit diagram of the electrical connections.

DESCRIPTION OF BEST MODE AND OTHER EMBODIMENTS

Figure 3:
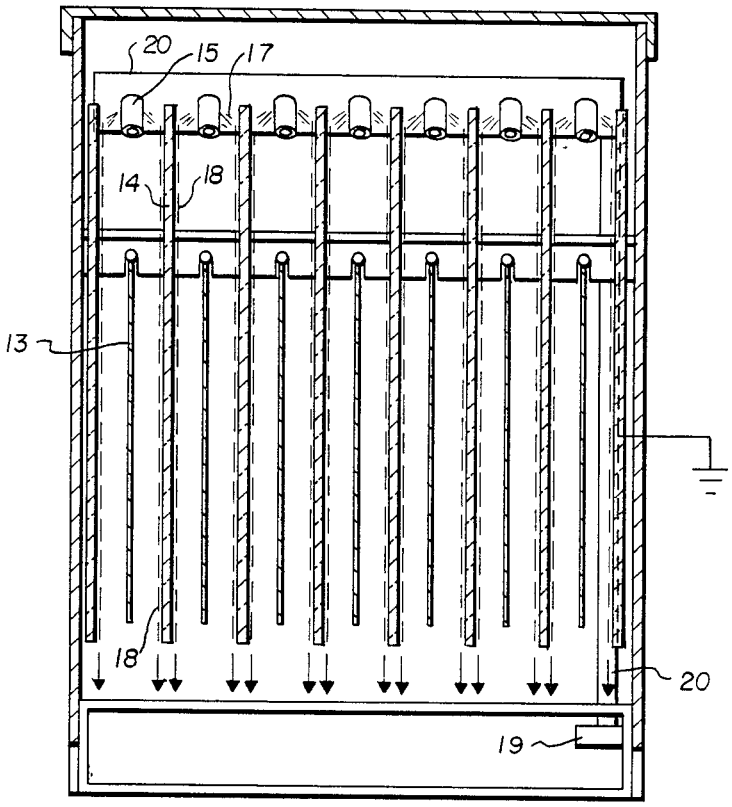
FIG. 3 shows diagrammatically a vertical cross-section of the electric dust collector along line 3—3 in FIG. 1.

The electric dust collector shown in FIGS. 1–4 includes a supporting case 1 defining a chamber for housing the elements of an electrical precipitator. The intake opening 2 for the air to be cleaned is at one end of the case and the output opening 3 for the cleaned air is at the opposite end. Associated with the output air opening is an electrically driven fan 4, which draws air in via the input opening 2 and then through the precipitator elements. The fan may also be placed together with the input opening, in which case it blows air through the precipitator. The case is also provided with an openable cover 5, through which the electrical equipment and other parts inside the case may be serviced. In the base part of the case there is further a sump 6, into which the precipitator rinsing water flows.

Figure 4:
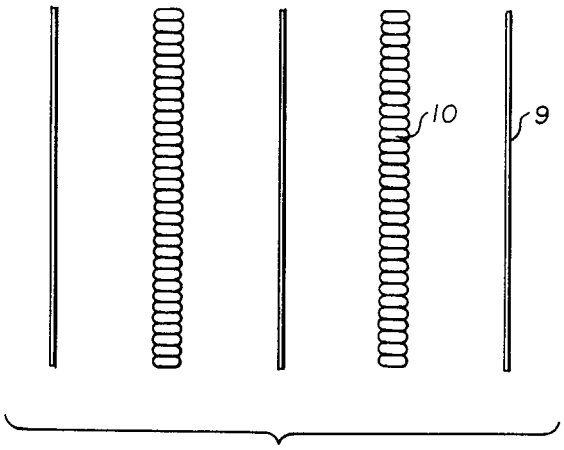
FIG. 4 shows in part an enlarged view of the ionization electrodes enlarged of the electric dust collector.
Figure 5:
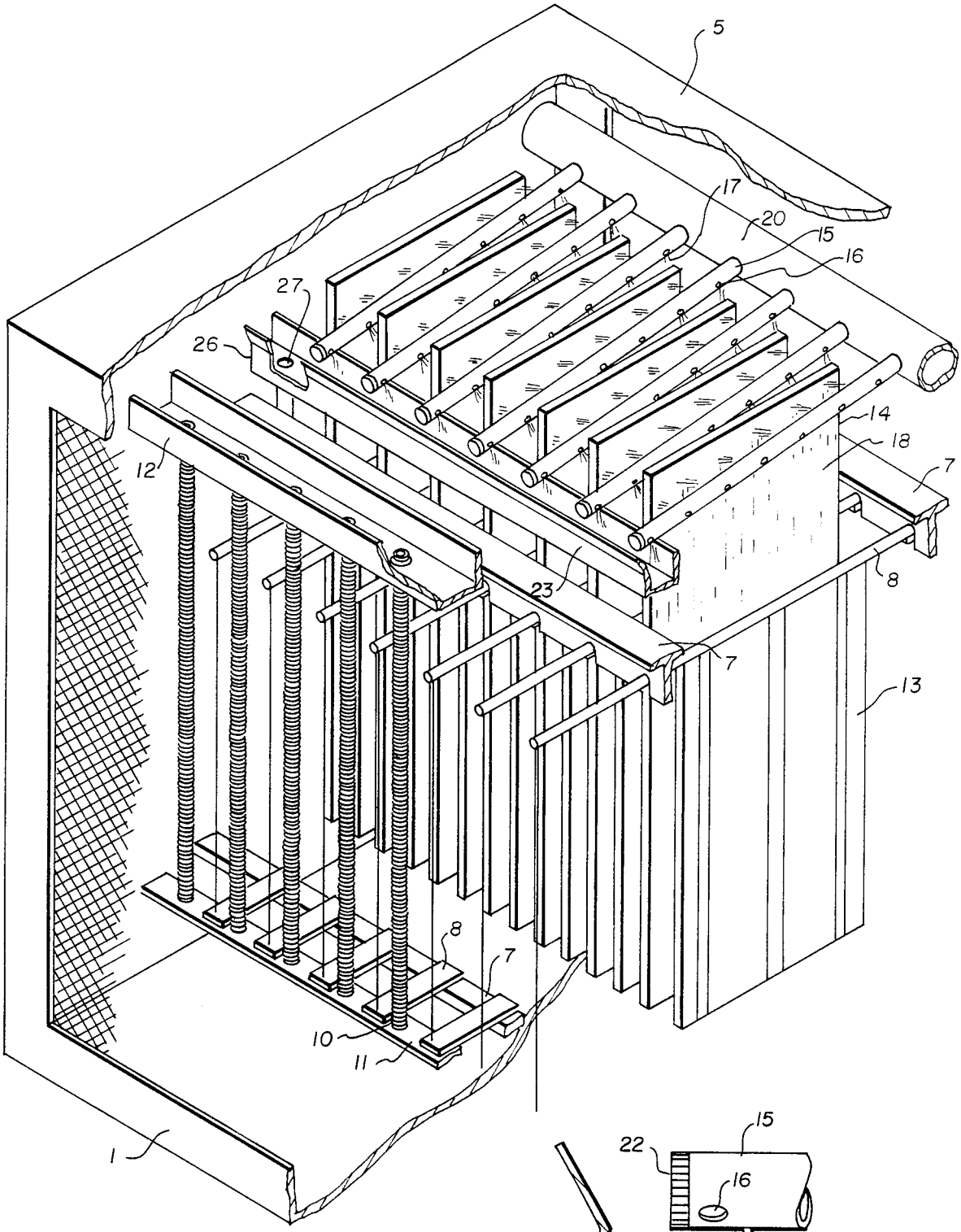
FIG. 5 shows a partial sectional view of the electric dust collector as seen in perspective.
Figure 6:
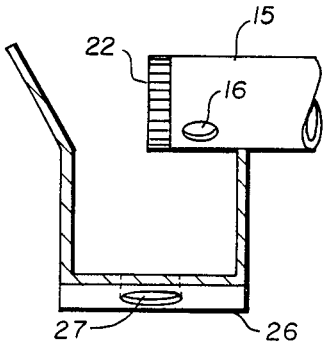
FIG. 6 shows in part an enlarged view of the water collection channel adjacent to the ends of the water distribution pipes.

According to the invention, near the input air opening of the case there is in the electric dust collector firstly an ionization device, which ionizes the air in a known manner. In the device is a group of positive ionization electrodes in a construction known as such, which in this embodiment are attached to a supporting frame 7, for example, by supporting heads 8 suspended from the upper and lower frame members. The electrodes 9 are thick metal wire, for example tungsten wire. The other electrode group of the ionization device is formed by the negative counter-electrodes 10 which are attached to another frame 11 between its upper and lower members in a vertical row with equal spacing. These electrodes 10 are materially thicker in cross-section, made for example from stainless steel wire, which is coiled in the form of a helical spring (FIGS. 1 and 4). Both electrode groups preferably are fitted so that they are situated in the same row parallel and at equal intervals to each other, thinner electrodes 9 alternating with thicker ones 10 (FIGS. 2 and 4). The electrodes may naturally also be situated and grouped in successive rows longitudinally along the precipitator. According to the invention, the construction of the electrodes is further special in that electrodes 10 are continuously rinsed with a water current so that charged dust particles possibly striking them do not remain attached but are washed off. The electrodes thus remain clean and the ionization device functions without fault. For rinsing there is in the upper member of the electrode supporting frame 11 a water channel or pipe 12 having holes in the base of which the electrodes 10 are placed, loosely fitting, as shown in FIG. 5 so that water can run through the holes downwards onto the electrodes. In place of electrodes in the form of a helical spring, there may also be used some kind of corresponding thick metal braid, chain, or wire rope.

The air current from the above mentioned ionization device goes to the electrostatic field of the precipitator, which is formed by a group of parallel plate electrodes 13 and 14 placed vertically in spaced apart relation relative to the direction of the air current. Of these, each alternate plate 13 serves as a field electrode and is connected to the positive pole of the voltage supply, and each other plate 14 when covered with water serves as a collector electrode and is connected to the negative pole of the voltage supply. Solid particles acquiring a positive charge from the ionization device travel to the negative collection electrode 14.

According to the invention, the said negative collection plates 14 are made of glass or other electrically insulating material wettable by water. Plates 14 are positioned vertically as shown in FIGS. 1, 3 and 5 and thus have upper and lower edges and substantially vertical surfaces on opposite sides of each plate. In addition, according to the invention, a continuous rinsing of them is arranged. Water comes to the collection plate 14 from parts such as sump 6, pump 19, inlet header 20 and the pipes 15 which are placed near to the upper edge of the plates and run in the same direction as this edge. In this embodiment, small nozzle holes 16 are made at equal intervals along the pipes 15, so that water jets 17 in the form of numerous fine sprays are directed from the pipes 15 slantingly downwards to the side surfaces of the glass plates at their upper edge. Another possible embodiment is to arrange the water distribution to the glass plate through narrow downward directed apertures in the direction of length of the pipe 15. The water then spreads as a thin, even film 18 over the surface of the glass plate, so that there remain no dry, unrinsed portions which would weaken the cleansing ability of the precipitator. Water film 18 is shown diagrammatically in FIG. 3 by broken line arrows on opposite sides of the plates 14.

The positive electrodes 13 on the other hand may be made for example from stainless steel and do not need to be rinsed since the dust particles only accumulate on the collection electrodes 14. The arrangement of the water distribution pipes and channels relative to the positive and negative electrodes is best shown in the perspective view of FIG. 5. A second water collection channel 23 is provided below the last water spray aperture 16 near the end 22 of pipe 15. Channel 23 is slanted downward toward a lower end 26 having a drain aperture 27 connected to a return header 24 leading back to sump 6. The pipes 15 are in turn slanted downward toward the channel 23 so that all water will drain from the pipes and from the channels when recirculating pump 19 in sump 6 is cut off.

In practice, the body of the device is earthed and the negative pole of the supply is connected to the earth lead, to which is also connected the negative electrodes 10 of the ionization device and the pipes 15, which are of metal or contain conductive parts through which electricity is conducted to the rinsing water. The positive terminal of the supply is connected to the positive ionization electrodes 9 of the ionization device and similarly to the plates forming the electrostatic field which are the positive field electrodes 13.

Should the conductivity of the water not be sufficient, as is sometimes possible, water conductivity may be improved by the addition of some suitable salt. The rinsing water may be led directly to a drain together with the accumulated impurities. It may also be arranged in a closed circuit as shown in the drawings, in which case the dust is separated from the water by means of a suitable precipitator.

The constructional parts of the device, such as the ionization device, the electrode groups and the electrostatic field electrodes, may be arranged so as to be easily removable and exchangeable in order to facilitate maintenance.

The embodiments of the device may vary within the scope of the patent claims below.

What is claimed is:

1. In an electric dust collector having a case defining a chamber through which a gas to be cleaned flows by a means of a fan, precipitator apparatus disposed within said case for removing solid particles from said gas comprising:

ionization means for providing a charge on said particles upstream of an electrostatic field, said ionization means including ionization electrodes and counter-electrodes and means for electrically connecting said ionization electrodes to a voltage supply having a polarity the same as that of said charged particles and said counter-electrodes to ground having a polarity opposite to that of said charged particles;

field means for forming said electrostatic field, said field means including field electrodes and collector electrodes, said collector electrodes comprising continuous films of electrically conductive water flowing over opposite sides of at least one plate having an upper edge and substantially vertical surfaces on said opposite sides;

means for electrically connecting said field electrodes to said voltage supply having a polarity the same as that of said charged particles;

distribution means for causing said films of electrically conductive water to flow over said side surfaces, said distribution means including a water pipe in spaced relation to each side of said at least one plate and extending in the direction of said upper edge and having apertures arranged to direct water currents in the form of sprays toward said side surfaces adjacent to said upper edge, said at least one plate consisting essentially of electrically insulating glass having wetting properties causing said water currents to spread evenly over said side surfaces so as to form said continuous water films and having electrically insulating properties such that said charged particles are not attracted to said at least one plate, and said distribution means comprising electrically conductive parts for causing electricity to be conducted to said water films; and, means for electrically connecting said conductive parts to ground having a polarity opposite to that of said charged particles so that said charged particles accumulate in said water films and are removed from the gas to be cleaned.

2. The dust collector of claim 1 which further comprises means for connecting both said distribution means and said counter-electrodes to ground of the same polarity.

3. The dust collector of claim 1 in which said distribution means further includes means for causing water to flow continuously over said counter-electrodes so as to keep said counter-electrodes clean.

* * * * *